US005918482A

United States Patent [19]

Potempa

[11] Patent Number: 5,918,482

[45] Date of Patent: Jul. 6, 1999

[54] CRYOGENIC RECTIFICATION SYSTEM FOR PRODUCING ULTRA-HIGH PURITY NITROGEN AND ULTRA-HIGH PURITY OXYGEN

[75] Inventor: Kevin John Potempa, Tonawanda, N.Y.

[73] Assignee: Praxair Technology, Inc., Danbury, Conn.

[21] Appl. No.: 09/024,196

[22] Filed: Feb. 17, 1998

[51] Int. Cl.[6] ..... F25B 3/00

[52] U.S. Cl. ..... 62/646; 62/653

[58] Field of Search ..... 62/646, 653

[56] References Cited

U.S. PATENT DOCUMENTS

| | | | |
|---|---|---|---|
| 4,091,633 | 5/1978 | Linde | 62/643 |
| 4,560,397 | 12/1985 | Cheung | 62/28 |
| 4,755,202 | 7/1988 | Cheung | 62/17 |
| 4,780,118 | 10/1988 | Cheung | 62/11 |
| 4,902,321 | 2/1990 | Cheung | 62/24 |
| 5,049,173 | 9/1991 | Cormier, Sr. et al. | 62/24 |
| 5,098,457 | 3/1992 | Cheung et al. | 62/24 |
| 5,195,324 | 3/1993 | Cheung | 62/24 |
| 5,582,032 | 12/1996 | Shelton et al. | 62/648 |
| 5,590,543 | 1/1997 | Agrawal et al. | 62/643 |

*Primary Examiner*—Ronald Capossela
*Attorney, Agent, or Firm*—Stanley Ktorides

[57] ABSTRACT

A system for the production of ultra-high purity nitrogen and ultra-high purity oxygen at high recovery by the cryogenic rectification of feed air employing a main column, an auxiliary column and a stripping column, wherein the stripping column is driven by main column kettle fluid and additional process fluid generated in the auxiliary column is utilized in the main column.

10 Claims, 3 Drawing Sheets

CRYOGENIC RECTIFICATION SYSTEM FOR PRODUCING ULTRA-HIGH PURITY NITROGEN AND ULTRA-HIGH PURITY OXYGEN

TECHNICAL FIELD

This invention relates generally to the cryogenic rectification of feed air to produce nitrogen and oxygen and, more particularly, to the production of ultra-high purity product such as is required by the electronics industry.

BACKGROUND ART

Ultra-high purity nitrogen, particularly at elevated pressure, is required in manufacturing processes that are very sensitive to contaminants, such as in the production of semiconductors and other electronic components. Ultra-high purity nitrogen can be effectively produced by the cryogenic rectification of feed air. Recently there has arisen a need for the use of ultra-high purity oxygen, along with ultra-high purity nitrogen, in such manufacturing processes. Ultra-high purity oxygen may be produced using a conventional cryogenic rectification plant for the production of ultra-high purity nitrogen; however such a system reduces the recovery of the ultra-high purity nitrogen and leads to higher power consumption compared to the conventional ultra-high purity nitrogen arrangement for any given quantity of nitrogen produced.

Accordingly, it is an object of this invention to provide a cryogenic rectification system which can produce both ultra high purity nitrogen and ultra-high purity oxygen while reducing the nitrogen recovery and power consumption penalties heretofore experienced with known systems.

SUMMARY OF THE INVENTION

The above and other objects, which will become apparent to one skilled in the art upon a reading of this disclosure, are attained by the present invention, one aspect of which is:

A method for producing ultra-high purity nitrogen and ultra-high purity oxygen by the cryogenic rectification of feed air comprising:

(A) passing first feed air into a main column and separating the first feed air within the main column by cryogenic rectification into oxygen-enriched fluid and nitrogen-richer fluid;

(B) passing second feed air into an auxiliary column and separating the second feed air within the auxiliary column by cryogenic rectification into nitrogen-enriched fluid and oxygen-richer fluid;

(C) passing nitrogen-enriched fluid from the auxiliary column into the upper portion of the main column;

(D) passing oxygen-containing fluid into the upper portion of a stripping column and down the stripping column against upflowing vapor to produce ultra-high purity oxygen fluid in the lower portion of the stripping column;

(E) vaporizing a portion of the ultra-high purity oxygen fluid by indirect heat exchange with oxygen-enriched fluid to produce said upflowing vapor;

(F) recovering another portion of the ultra-high purity oxygen fluid as product ultra-high purity oxygen; and (G) recovering nitrogen-richer fluid as product ultra-high purity nitrogen.

Another aspect of this invention is:

Apparatus for producing ultra-high purity nitrogen and ultra-high purity oxygen by the cryogenic rectification of feed air comprising:

(A) a main column having a top condenser and means for passing feed air into the main column;

(B) an auxiliary column having a top condenser and means for passing feed air into the auxiliary column;

(C) a stripping column having a bottom reboiler;

(D) means for passing fluid from the lower portion of the main column into the main column top condenser and from the main column top condenser into the stripping column bottom reboiler;

(E) means for passing fluid from the upper portion of the auxiliary column into the auxiliary column top condenser and from the auxiliary column top condenser into the upper portion of the main column;

(F) means for passing fluid from at least one of the main column and the auxiliary column into the upper portion of the stripping column; and (G) means for recovering ultra-high purity oxygen from the lower portion of the stripping column, and means for recovering ultra-high purity nitrogen from the upper portion of the main column.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to in the liquid phase. Partial condensation is the separation process whereby cooling of a vapor mixture can be used to concentrate the volatile component(s) in the vapor phase and thereby the less volatile component (s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "top condenser" means a heat exchange device that generates column downflow liquid from column vapor.

As used herein, the term "bottom reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "stripping column" means a column operated with sufficient vapor upflow relative to liquid downflow to achieve separation of a volatile component from the liquid into the vapor in which the volatile component becomes progressively richer upwardly.

As used herein, the term "ultra-high purity nitrogen" means a fluid having a nitrogen concentration of at least 99.99 mole percent and having an oxygen concentration of less than 1.0 parts per million (ppm), preferably less than 0.1 ppm.

As used herein, the term "ultra-high purity oxygen" means a fluid having an oxygen concentration of at least 99.99 mole percent.

Figure 1:
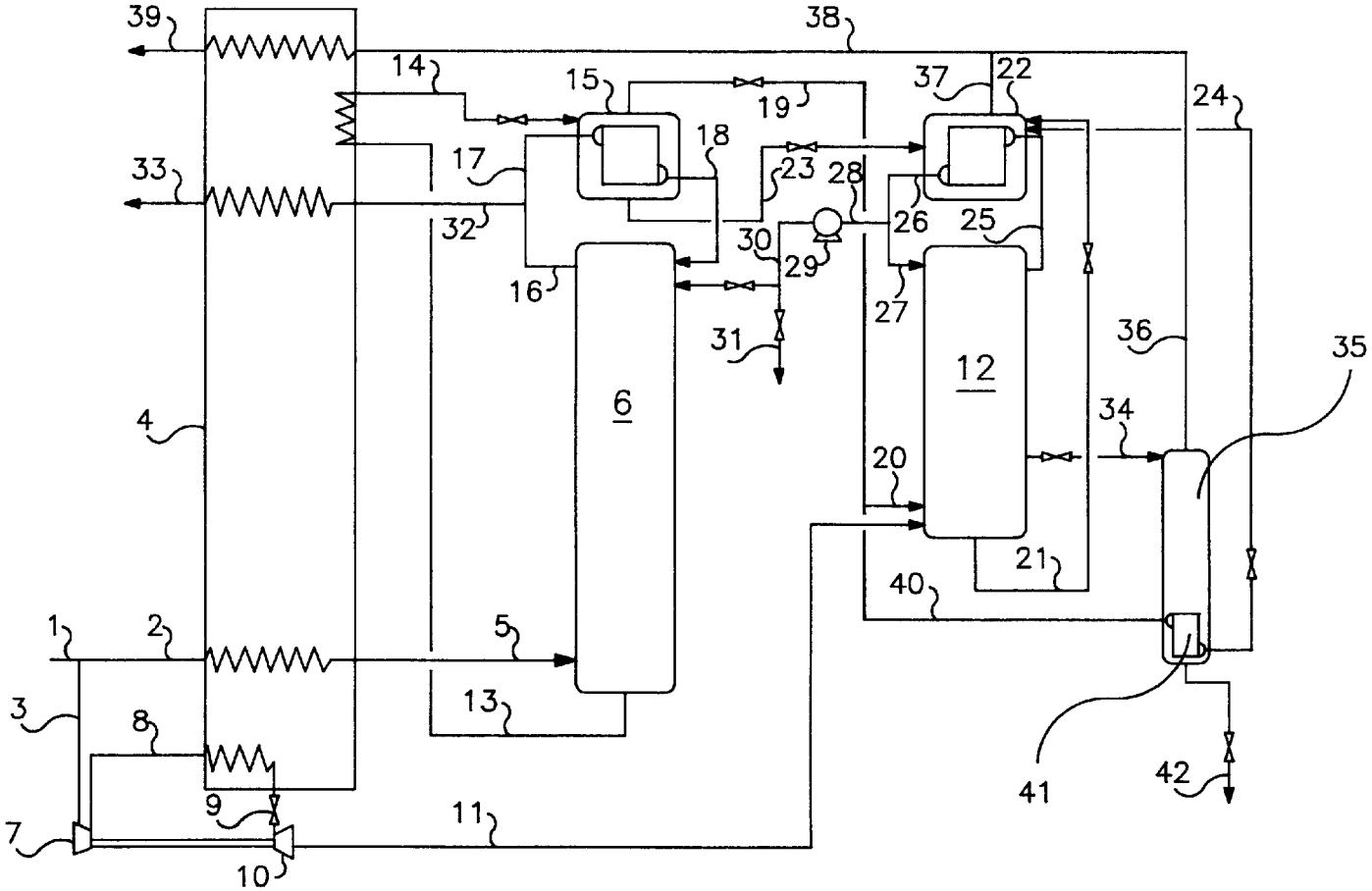
FIG. 1 is a schematic representation of one preferred embodiment of the cryogenic rectification system of this invention.

The numerals in the Drawings are the same for the common elements.

DETAILED DESCRIPTION

In the practice of this invention the auxiliary column, which operates at a pressure less than that of the main column, is decoupled from the operation of the ultra-high purity oxygen stripping column because the stripping column is reboiled by fluid from the main column. This enables the auxiliary column to operate at an even lower pressure thus improving the recovery of nitrogen from that column and ultimately from the system in general. The invention will be described in greater detail with reference to the Drawings.

Referring now to FIG. 1, feed air 1 is divided into first feed air stream 2 and second feed air stream 3. First feed air stream 2 is cooled by indirect heat exchange with return streams in primary heat exchanger 4, and resulting cooled first feed air stream 5 is passed into the lower portion of main column 6. Second feed air stream 3 is compressed by passage through compressor 7, and the compressed second feed air stream 8 is cooled by partial traverse of primary heat exchanger 4. Cooled compressed second feed air stream 9 is turboexpanded by passage through turboexpander 10 and the resulting turboexpanded second feed air stream 11 is passed into the lower portion of auxiliary column 12.

Main column 6 is operating at a pressure within the range of from 95 to 180 pounds per square inch absolute (psia). Within main column 6 the first feed air is separated by cryogenic rectification into oxygen-enriched fluid and nitrogen-richer fluid. oxygen-enriched fluid is withdrawn from the lower portion of main column 6 as liquid in stream 13 and subcooled by partial traverse of primary heat exchanger 4. Resulting subcooled oxygen-enriched liquid 14 is then passed into the boiling side of main column top condenser 15. Nitrogen-richer fluid is withdrawn from the upper portion of main column 6 a vapor in stream 16 and a portion 17 is passed into the condensing side of top condenser 15 wherein it is condensed by indirect heat exchange with the oxygen-enriched liquid which is partially vaporized. The resulting nitrogen-richer liquid is passed in stream 18 into the upper portion of main column 6 as reflux. Resulting oxygen-enriched vapor is withdrawn from main column top condenser 15 in stream 19 and a portion 20 is passed into the lower portion of auxiliary column 12.

Auxiliary column 12 is operating at a pressure less than that of main column 6 and within the range of from 45 to 65 psia. Within auxiliary column 12 the feeds into that column are separated by cryogenic rectification into nitrogen-enriched fluid and oxygen-richer fluid. Oxygen-richer fluid is withdrawn from the lower portion of auxiliary column 12 as liquid in stream 21 and passed into the boiling side of auxiliary column top condenser 22. Oxygen-enriched liquid is also passed into the boiling side of top condenser 22 from top condenser 15 in stream 23. A third fluid 24 taken from the bottom reboiler of the ultra-high purity stripping column, as will be discussed further below, is also passed into the boiling side of top condenser 22.

Nitrogen-enriched fluid is passed as vapor stream 25 from the upper portion of auxiliary column 12 into the condensing side of auxiliary column top condenser 22 wherein it is condensed by indirect heat exchange with the fluids passed into the boiling side of top condenser 22. Resulting nitrogen-enriched liquid is withdrawn from top condenser 22 in stream 26 and a portion 27 returned to auxiliary column 12 as reflux. A second portion 28 of the nitrogen-enriched liquid is pumped to a higher pressure by passage through liquid pump 29 and resulting pressurized nitrogen-enriched liquid 30 is passed into the upper portion of main column 6 as additional reflux. If desired, a portion 31 of the nitrogen-enriched liquid may be recovered as product liquid nitrogen.

The addition of the nitrogen-enriched liquid from the auxiliary column to the main column improves the amount and the quality of the liquid reflux in main column 6 thus enabling the production of nitrogen-richer fluid within that column both at high recovery and at ultra-high purity. A portion 32 of nitrogen-richer vapor 16 is warmed by passage through primary heat exchanger 4 and recovered as product ultra-high purity nitrogen in stream 33.

A portion of the oxygen-richer fluid is withdrawn from the lower portion of auxiliary column 12 in liquid stream 34 and passed into the upper portion, preferably the top, of stripping column 35 as stripping column feed. The feed to the stripping column 35 should not contain any heavy contaminants, i.e components less volatile than oxygen, such as methane, krypton and xenon, so as to avoid having any of these heavy contaminants in the ultra-high purity oxygen product 42. This can be accomplished by withdrawing the feed from an intermediate location of the auxiliary column, e.g. above the feed air input level. The stripping column feed passes down stripping column 35 against upflowing vapor and in the process the more volatile components in the stripping column feed, such as nitrogen and argon, are passed out from the downflowing liquid and into the upflowing vapor, producing ultra-high purity oxygen fluid in the lower portion of stripping column 35, and waste vapor which is passed out from stripping column 35 in stream 36. Stream 36 is combined with vapor stream 37 from auxiliary column top condenser 22 to form waste stream 38 which is warmed by passage through primary heat exchanger 4 and removed from the system in stream 39.

A portion 40 of the oxygen-enriched vapor 19 from main column top condenser 15 is passed into stripping column bottom reboiler 41 wherein it is condensed by indirect heat exchange with ultra-high purity oxygen liquid in the lower portion of stripping column 35. A portion of the ultra-high purity oxygen liquid is vaporized to generate the aforesaid upflowing vapor in stripping column 35. The resulting condensed oxygen-enriched liquid is passed from bottom reboiler 41 to top condenser 22 in stream 24 as was previously described. The remaining portion of the ultra-high purity oxygen fluid is recovered, as vapor and/or liquid, as product ultra-high purity oxygen from the lower portion of stripping column 35. The embodiment of the invention illustrated in FIG. 1 shows the recovery of ultra-high purity oxygen product as liquid stream 42.

Figure 2:
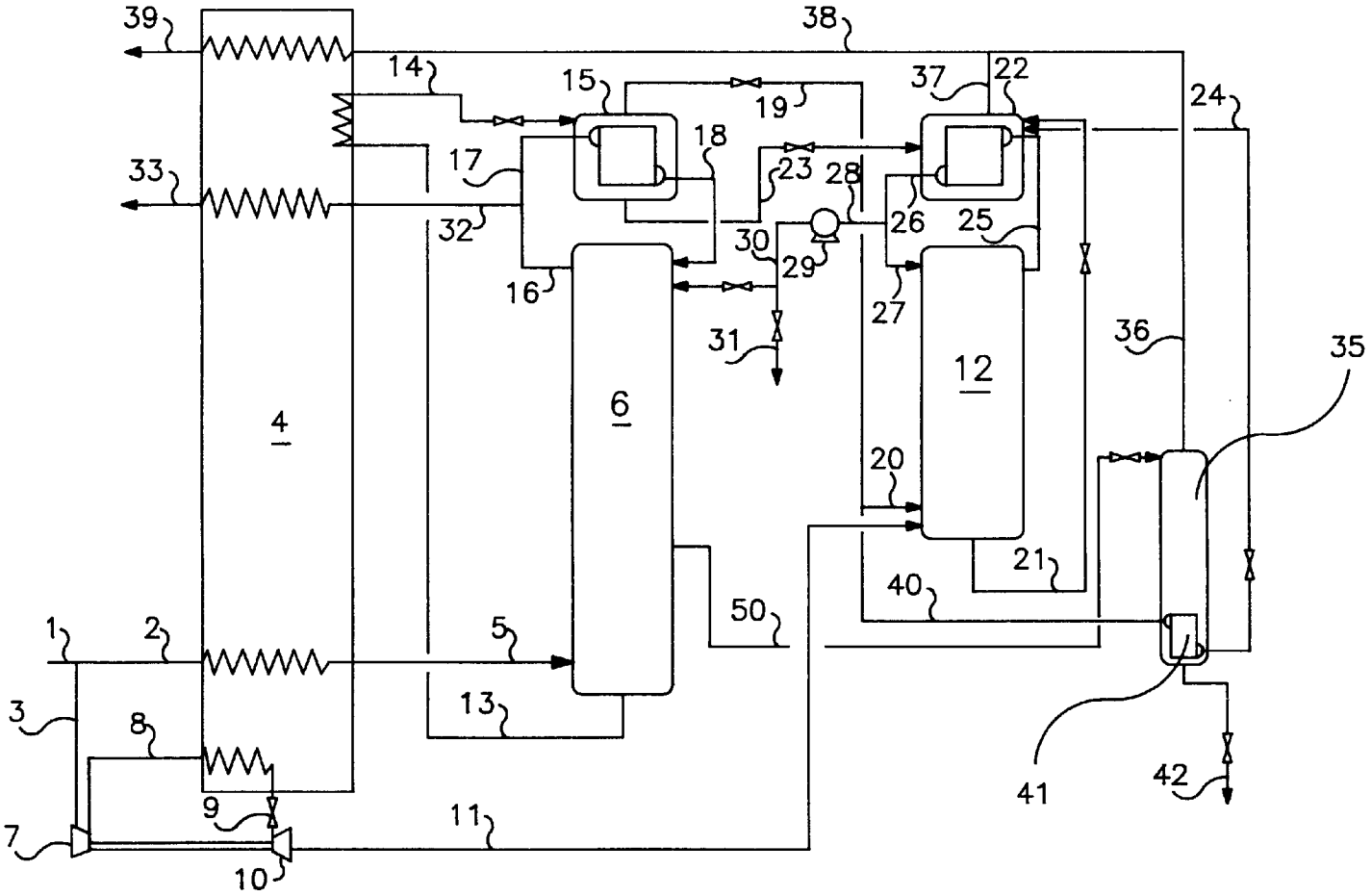
FIG. 2 is a schematic representation of another preferred embodiment of the cryogenic rectification system of this invention.
Figure 3:
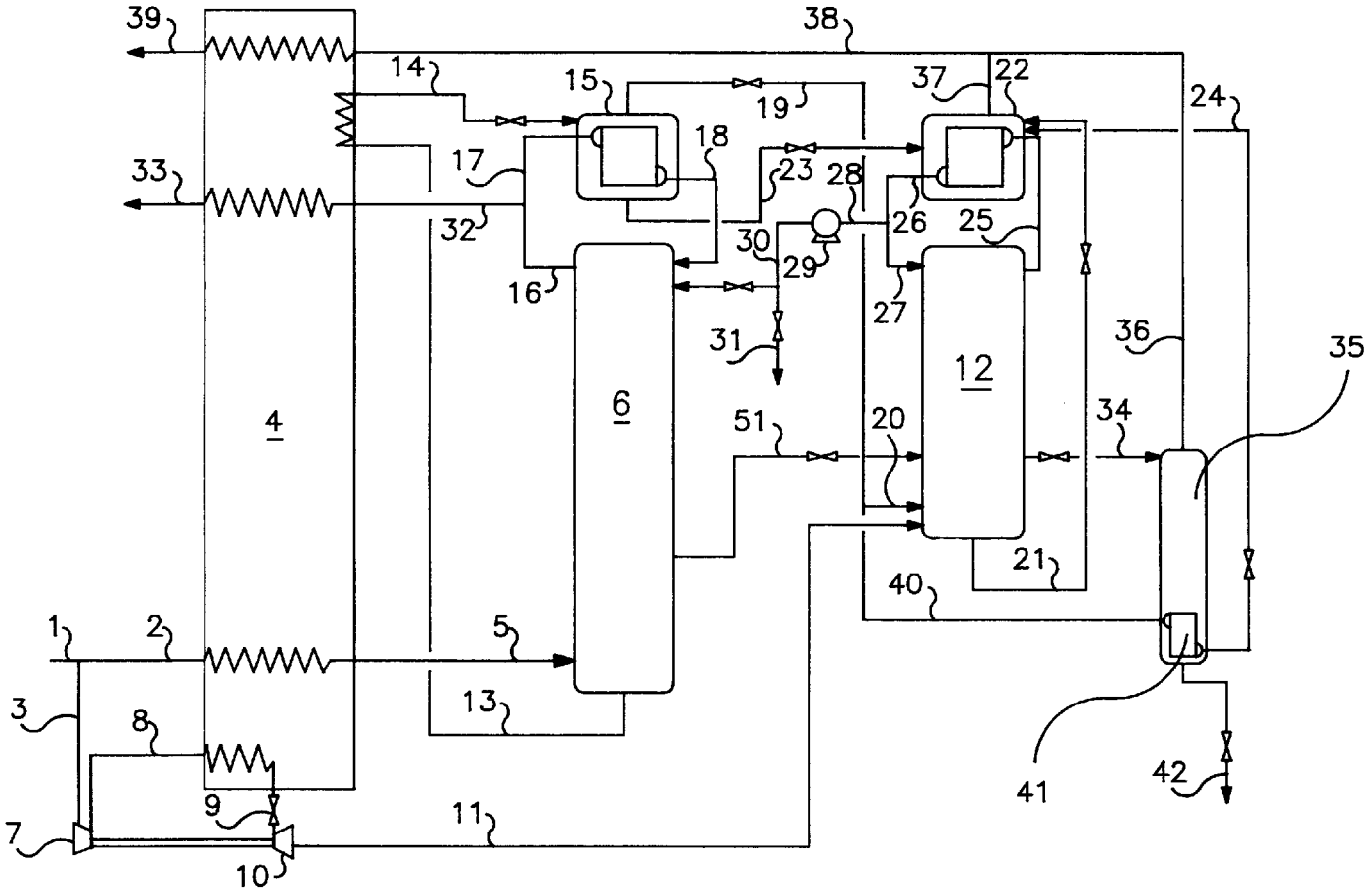
FIG. 3 is a schematic representation of yet another preferred embodiment of the cryogenic rectification system of this invention.

FIGS. 2 and 3 illustrate other preferred embodiments of the invention. The numerals in FIGS. 2 and 3 are the same for the common elements and these common elements will not be described again in detail.

Referring now to FIG. 2, the oxygen-containing feed into stripping column 35 is taken from the lower portion of main column 6 above the feed air input level rather than from auxiliary column 12 as in the embodiment illustrated in FIG. 1. In the embodiment illustrated in FIG. 2, oxygen-enriched fluid is withdrawn from the lower portion of main column 6 in liquid stream 50 and passed into the upper portion of stripping column 35 as the stripping column feed.

In the embodiment of the invention illustrated in FIG. 3, oxygen-enriched fluid is passed from main column 6 in stream 51 as an additional feed into auxiliary column 12, and oxygen-richer liquid from the auxiliary column is passed in liquid stream 34, as in the embodiment illustrated in FIG. 1, from auxiliary column 12 into stripping column 35 as the stripping column feed.

Now with the practice of this invention one can produce both ultra-high purity nitrogen and ultra-high purity oxygen at high recovery. Although the invention has been described in detail with reference to certain preferred embodiments, those skilled in the art will recognize that there are other embodiments of the invention within the spirit and the scope of the claims.

I claim:

1. A method for producing ultra-high purity nitrogen and ultra-high purity oxygen by the cryogenic rectification of feed air comprising:

(A) passing first feed air into a main column and separating the first feed air within the main column by cryogenic rectification into oxygen-enriched fluid and nitrogen-richer fluid;

(B) passing second feed air into an auxiliary column and separating the second feed air within the auxiliary column by cryogenic rectification into nitrogen-enriched fluid and oxygen-richer fluid;

(C) passing nitrogen-enriched fluid from the auxiliary column into the upper portion of the main column;

(D) passing oxygen-containing fluid into the upper portion of a stripping column and down the stripping column against upflowing vapor to produce ultra-high purity oxygen fluid in the lower portion of the stripping column;

(E) vaporizing a portion of the ultra-high purity oxygen fluid by indirect heat exchange with oxygen-enriched fluid to produce said upflowing vapor;

(F) recovering another portion of the ultra-high purity oxygen fluid as product ultra-high purity oxygen; and (G) recovering nitrogen-richer fluid as product ultra-high purity nitrogen.

2. The method of claim 1 wherein the oxygen-containing fluid comprises oxygen-richer fluid.

3. The method of claim 1 wherein the oxygen-containing fluid comprises oxygen-enriched fluid.

4. The method of claim 1 further comprising passing oxygen-enriched fluid from the main column into the auxiliary column.

5. The method of claim 1 further comprising recovering a portion of the nitrogen-enriched fluid from the auxiliary column.

6. Apparatus for producing ultra-high purity nitrogen and ultra-high purity oxygen by the cryogenic rectification of feed air comprising:

(A) a main column having a top condenser and means for passing feed air into the main column;

(B) an auxiliary column having a top condenser and means for passing feed air into the auxiliary column;

(C) a stripping column having a bottom reboiler;

(D) means for passing fluid from the lower portion of the main column into the main column top condenser and from the main column top condenser into the stripping column bottom reboiler;

(E) means for passing fluid from the upper portion of the auxiliary column into the auxiliary column top condenser and from the auxiliary column top condenser into the upper portion of the main column;

(F) means for passing fluid from at least one of the main column and the auxiliary column into the upper portion of the stripping column; and (G) means for recovering ultra-high purity oxygen from the lower portion of the stripping column, and means for recovering ultra-high purity nitrogen from the upper portion of the main column.

7. The apparatus of claim 6 wherein the means for passing fluid from the auxiliary column top condenser into the upper portion of the main column includes a liquid pump.

8. The apparatus of claim 6 further comprising means for passing fluid from the lower portion of the main column into the lower portion of the auxiliary column.

9. The apparatus of claim 6 further comprising means for passing fluid from the main column top condenser into the lower portion of the auxiliary column.

10. The apparatus of claim 6 wherein the means for passing feed air into the auxiliary column includes a turboexpander.

* * * * *